US006938710B2

(12) United States Patent
Simmons

(10) Patent No.: US 6,938,710 B2
(45) Date of Patent: Sep. 6, 2005

(54) BIT HEAD RETAINING SYSTEM AND METHOD OF INSTALLING A BIT HEAD IN A PERCUSSION DRILL

(75) Inventor: Rob A. Simmons, Mansfield, TX (US)

(73) Assignee: Sandvik AB, Sandviken (SE)

( * ) Notice: Subject to any disclaimer, the term of this patent is extended or adjusted under 35 U.S.C. 154(b) by 4 days.

(21) Appl. No.: 10/606,994

(22) Filed: Jun. 27, 2003

(65) Prior Publication Data

US 2004/0262042 A1 Dec. 30, 2004

(51) Int. Cl.[7] ..... E21B 10/36; E21B 1/38
(52) U.S. Cl. ..... 175/57; 175/415
(58) Field of Search ..... 175/300, 414, 175/415, 57; 173/132

(56) References Cited

U.S. PATENT DOCUMENTS 4,350,348 A * 9/1982 Cox ..... 277/543
4,538,928 A 9/1985 Muma
4,694,911 A 9/1987 Kennedy
5,065,827 A 11/1991 Meyers et al.
5,535,838 A 7/1996 Keshavan et al.
5,647,447 A 7/1997 Jones
5,699,867 A 12/1997 Jones
5,921,332 A * 7/1999 Spedale, Jr. ..... 175/415
6,035,953 A * 3/2000 Rear ..... 175/171
6,070,678 A 6/2000 Pascale
6,290,008 B1 9/2001 Portwood et al.
6,698,537 B2 * 3/2004 Pascale et al. ..... 175/300

* cited by examiner

*Primary Examiner*—David Bagnell
*Assistant Examiner*—Shane Bomar
(74) *Attorney, Agent, or Firm*—Burns, Doane, Swecker & Mathis, LLP

(57) ABSTRACT

A bit head retaining system includes a bit head having an upper end and a working face, and a retention sleeve adapted to be connected to an end of a drill casing and having an internal opening in which at least a portion of the bit head above the working face is disposed, the bit head being secured to the retention sleeve so as to be axially immovable relative to the retention sleeve. A method of installing a bit head in a percussion drill is also disclosed.

21 Claims, 1 Drawing Sheet

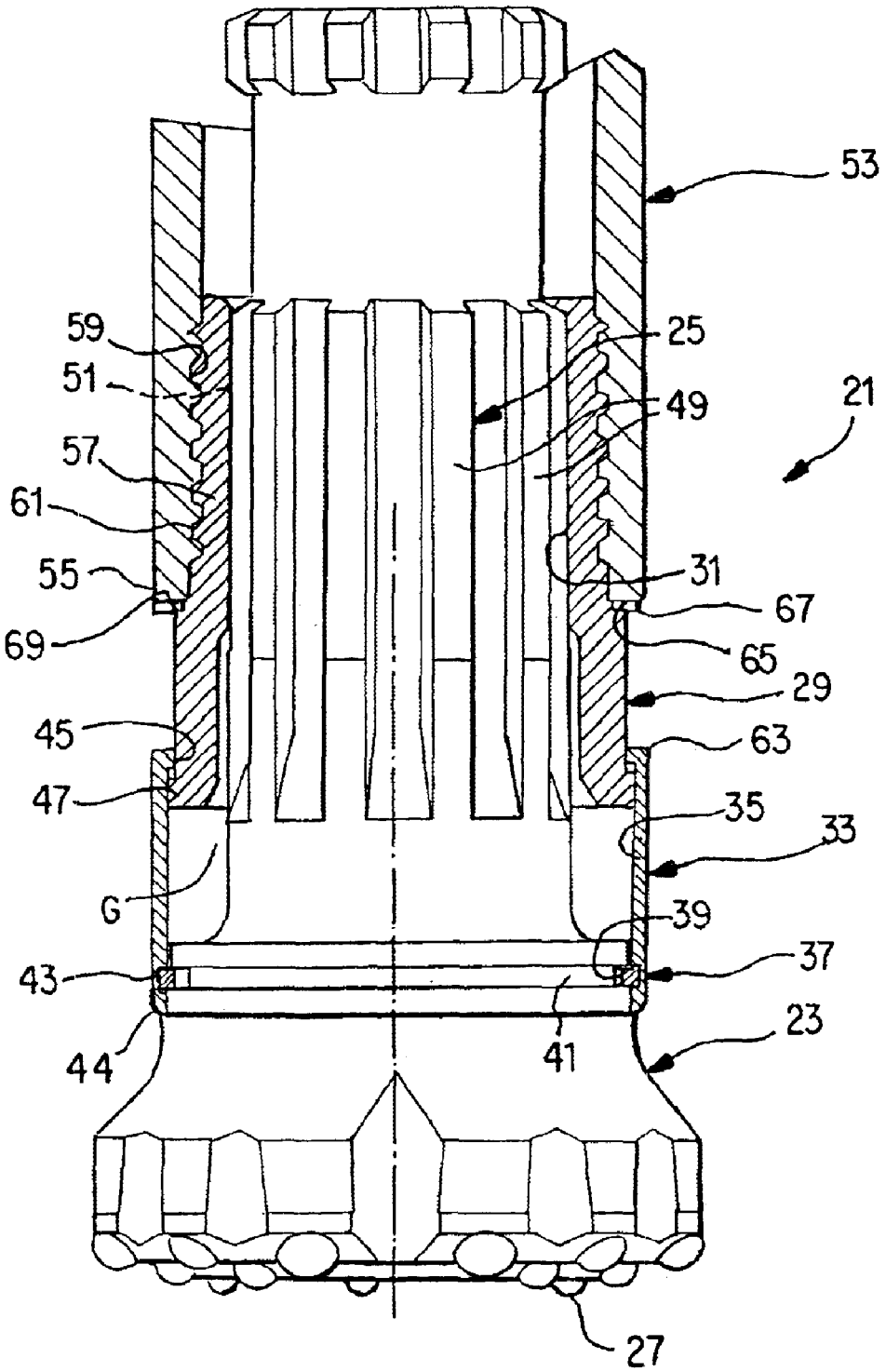
53
59
25
51
49
21
57
61
31
55
67
69
65
29
45
63
47
35
33
G
39
43
37
44
41
23
27

BIT HEAD RETAINING SYSTEM AND METHOD OF INSTALLING A BIT HEAD IN A PERCUSSION DRILL

BACKGROUND AND SUMMARY

In earth boring operations involving use of earth boring percussion bits, it is desirable to provide a technique of keeping a bit head connected to a piston case even though the bit head has broken. If the bit head becomes detached from the piston case and is left in the hole, it is necessary to retrieve the bit head from the hole, which can be costly and difficult, and, if retrieval is not possible, it may be necessary to abandon the hole. Various systems have been devised for retaining a broken bit head relative to a piston case. Several of these system are disclosed in U.S. Pat. Nos. 5,065,827, 5,647,447, and 6,070,678, the disclosures of which are incorporated by reference. It is desirable to provide a bit head retention system that will retain a broken bit head relative to a piston case during earth boring operations.

In accordance with an aspect of the present invention, a bit head retaining system includes a bit head having an upper end and a working face, a driver sub having an internal opening in which the upper end of the bit head is axially movable, and a retention sleeve having an internal opening in which at least a portion of the bit head above the working face and at least a portion of the driver sub are disposed, the retention sleeve being axially immovable relative to the bit head.

In accordance with another aspect of the present invention, a bit head retaining system includes a bit head having an upper end and a working face, and a retention sleeve adapted to be connected to an end of a drill casing and having an internal opening in which at least a portion of the bit head above the working face is disposed, the bit head being secured to the retention sleeve so as to be axially immovable relative to the retention sleeve.

In accordance with yet another aspect of the present invention, a method of installing a bit head in a percussion drill includes inserting an upper end of a bit head into an internal axial opening at a first end of a driver sub, sliding a retention sleeve over a second end of the driver sub until an internal recess in the retention sleeve aligns with an external recess in the bit head, securing the bit head relative to the retention sleeve with a retention member disposed in the external recess in the bit head and in the internal recess in the retention sleeve, and attaching the second end of the driver sub to a piston case.

BRIEF DESCRIPTION OF THE DRAWINGS

The features and advantages of the present invention are well understood by reading the following detailed description in conjunction with the drawing in which like numerals indicate similar elements.

DETAILED DESCRIPTION

As seen in the drawing, a bit head retaining system 21 according to an embodiment of the present invention includes a bit head 23 having an upper end 25 and a working face 27. A driver sub 29 having an internal opening 31 in which the upper end 25 of the bit head 23 is axially movable is preferably provided. An annular gap G is defined between the driver sub 29 and the upper end 25 of the bit head 23.

A retention sleeve 33 having an internal opening 35 in which at least a portion of the bit head 23 above the working face 27 and at least a portion of the driver sub 29 are disposed is preferably provided. The retention sleeve 33 is preferably axially immovable relative to the bit head 23. The retention sleeve 33 is preferably axially movable relative to the driver sub 29. The retention sleeve 33 preferably completely covers the gap G between the drive sub 29 and the upper end 25 of the bit head 23 so that debris cannot enter the gap.

The retention sleeve 33 is preferably secured to the bit head 23 by a retention arrangement 37. The retention arrangement 37 preferably includes an internal recess 39 in the retention sleeve 33, an external recess 41 in the bit head 23, and a retention member 43 disposed in the internal recess and the external recess. The internal recess 39 in the retention sleeve 33 and the external recess 41 in the bit head 23 are preferably peripheral grooves extending around an entire periphery of the retention sleeve and the bit head. The retention member 43 is preferably adapted to be compressed into the external recess 41 in the bit head, or, if desired or necessary, expanded into the internal recess 39 in the retention sleeve 33, to permit a first end 44 of the retention sleeve to axially slide over the bit head so that the internal recess in the retention sleeve and the external recess in the bit head are aligned. The retention member 43 is preferably a split ring. The retention sleeve 33 and the bit head 23 are preferably rotatable relative to each other.

The retention sleeve 33 preferably includes an internal flange 45 and the driver sub 29 preferably includes an external flange 47 that limit axial movement of the retention sleeve relative to the driver sub. More particularly, the flanges 45 and 47 preferably limit the downward movability, i.e., toward the working face 27 of the bit head 23, of the retention sleeve 33 relative to the driver sub 29. The retention sleeve 33 is preferably rotatable relative to the driver sub 29.

The upper end 25 of the bit head 23 preferably has external splines 49 and the driver sub 29 preferably has internal splines 51 that correspond to the external splines so that the bit head is axially movable but not rotatable relative to the driver sub. A piston case 53 preferably has an end portion 55 to which a second end 57 of the driver sub 29 is secured. The end portion 55 of the piston case 53 preferably has internal threads 59, and the driver sub 29 preferably has external threads 61 by its end 57. The driver sub 29 is preferably attached to the end portion 55 of the piston case 53 by the external threads 61 of the driver sub mating with the internal threads 59 of the end portion, whereby the piston case 53 and the driver sub 29 together form a tubular structure.

The retention sleeve 33 is preferably axially movable relative to the driver sub 29 such that the internal flange 45 is movable downwardly to a point at which the internal flange contacts the external flange 47 of the driver sub 29 and upwardly to a point at which the top end 63 of the retention sleeve contacts an end face 65 of the piston case 53 or, preferably, a wear ring 67 disposed between the end face of the piston case and a surface of a ledge 69 on the driver sub 29. Contact between the end face 65 and the ledge 69, or between the end face, the wear ring 67, and the ledge preferably limits an amount that the driver sub 29 can extend into the piston case 53.

The bit head retaining system 21 is well-suited for installation on new piston cases 53 or for retrofits on existing piston cases. To install a bit head 23 in a percussion drill having a piston case 53, the upper end 25 of the bit head is inserted into the internal axial opening 31 at a first end of the driver sub 29. The retention sleeve 33 is slid over a second end of the driver sub 29 until the internal recess 39 in the retention sleeve aligns with the external recess 41 in the bit head 23. The bit head 23 is secured relative to the retention sleeve 33 with a retention member 43 disposed in the external recess 41 in the bit head 23 and in the internal recess 39 in the retention sleeve. The second end 57 of the driver sub 29 is attached to the piston case 53 by a suitable attachment technique, such as by external threads 61 on the second end of the driver sub mating with internal threads 59 on the end portion 55 of the piston case. The bit head 23 is preferably secured relative to the retention sleeve 33 so that the bit head is axially immovable relative to the retention sleeve, yet is rotatable relative to the retention sleeve.

While this invention has been illustrated and described in accordance with a preferred embodiment, it is recognized that variations and changes may be made therein without departing from the invention as set forth in the claims.

What is claimed is:

1. A bit head retaining system, comprising:

a bit head having an upper end and a working face;

a piston case and a driver sub disposed above the working face, the driver sub connected to a lower end of the piston case to form therewith a tubular structure, the driver sub having an internal opening in which the upper end of the bit head is axially movable; and a retention sleeve having an internal opening in which at least a portion of the bit head above the working face and at least a portion of the driver sub are disposed, the retention sleeve being axially immovable relative to the bit head, wherein an upper portion of the retention sleeve is axially movable relative to the tubular structure, and the tubular structure includes a stop structure limiting the downward axial travel of the retention sleeve relative to the tubular structure.

2. The bit head retaining system as set forth in claim 1, wherein the retention sleeve is secured to the bit head by a retention arrangement.

3. The bit head retaining system as set forth in claim 2, wherein the retention arrangement includes an internal recess in the retention sleeve, an external recess in the bit head, and a retention member disposed in the internal recess and the external recess.

4. The bit head retaining system as set forth in claim 3, wherein the retention member is a split ring.

5. The bit head retaining system as set forth in claim 1, wherein the retention sleeve includes an internal flange and the driver sub includes an external flange that defines the stop structure that limits the downward axial movement of the retention sleeve relative to the tubular structure.

6. The bit head retaining system as set forth in claim 1, wherein the upper end of the bit head has external splines and the driver sub has internal splines that correspond to the external splines.

7. The bit head retaining system as set forth in claim 1, wherein the piston case has an end portion with internal threads, and wherein the driver sub has external threads, the external threads of the driver sub mating with the internal threads of the end portion.

8. The bit head retaining system as set forth in claim 1, wherein the stop structure is disposed on the piston case.

9. The bit head retaining system as set forth in claim 8, wherein a bottom end of the piston case possesses the stop structure, and further comprising a wear ring disposed at the bottom end of the piston case to prevent direct contact between the retention sleeve and the piston case.

10. The bit head retaining system as set forth in claim 1, wherein the retention sleeve covers an axial gap defined between the driver sub and the bit head.

11. The bit head as set forth in claim 1, wherein the bit head is rotatable relative to the retention sleeve about a center axis of the retention sleeve, the retention sleeve being axially immovable relative to the bit head in all rotational positions of the bit head relative to the retention sleeve.

12. A bit head retaining system, comprising:

a bit head having an upper end and a working face; and a retention sleeve adapted to be connected to an end of a drill casing and having an internal opening in which at least a portion of the bit head above the working face is disposed, the bit head being secured to the retention sleeve so as to be axially immovable relative to the retention sleeve, wherein the bit head is rotatable relative to the retention sleeve about a center axis of the retention sleeve, the bit head being axially immovable relative to the retention sleeve in all rotational positions of the bit head relative to the retention sleeve.

13. The bit head retaining system as set forth in claim 12, wherein the retention sleeve includes an internal recess and the bit head includes an external recess, and the bit head is secured to the retention sleeve by a retention member disposed in the internal recess and the external recess.

14. The bit head retaining system as set forth in claim 13, wherein the retention member is a split ring.

15. The bit head retaining system as set forth in claim 12, wherein an upper end of the retention sleeve includes an internal ledge for connecting the retention sleeve to an end of a drill casing.

16. A method of installing a bit head in a percussion drill, comprising:

inserting an upper end of a bit head into an internal axial opening at a first end of a driver sub;

sliding a retention sleeve over a second end of the driver sub until an internal recess in the retention sleeve aligns with an external recess in the bit head;

securing the bit head relative to the retention sleeve with a retention member disposed in the external recess in the bit head and in the internal recess in the retention sleeve; and attaching the second end of the driver sub to a piston case, wherein the piston case and the driver sub together form a tubular structure, and attaching the retention sleeve to the tubular structure.

17. The method as set forth in claim 16, wherein the retention member is a split ring.

18. The method as set forth in claim 16, wherein the bit head is secured relative to the retention sleeve so that the bit head is axially immovable relative to the retention sleeve.

19. The method as set forth in claim 18, wherein the bit head is secured relative to the retention sleeve so that the bit head is rotatable relative to the retention sleeve.

20. The method as set forth in claim 19, wherein the retention sleeve is axially immovable relative to the bit head in all rotational positions of the bit head relative to the retention sleeve.

21. The method as set forth in claim 18, wherein the bit head is axially movable relative to the tubular structure, the tubular structure including a stop structure for limiting axial movement of the retainer sleeve relative to the tubular structure.

* * * * *